United States Patent [19]

Austermühle

[11] 4,239,511

[45] Dec. 16, 1980

[54] PROCESS AND APPARATUS FOR COOLING COKE OVEN GAS

[75] Inventor: Friedrich-Paul Austermühle, Kaarst, Fed. Rep. of Germany

[73] Assignee: Krupp-Koppers GmbH, Essen, Fed. Rep. of Germany

[21] Appl. No.: 969,338

[22] Filed: Dec. 14, 1978

[51] Int. Cl.[3] ..... B01D 47/00

[52] U.S. Cl. ..... 55/84; 55/222; 55/269; 201/30; 165/DIG. 1; 165/113; 585/800; 585/804

[58] Field of Search ..... 55/80, 82, 85, 84, 89, 55/222, 228, 41, 42, 269; 201/28-30; 585/804, 800; 208/103, 105; 165/111-113, 99, DIG. 1; 62/332, 65, 93; 196/138, 140, 141

[56] References Cited

U.S. PATENT DOCUMENTS

| | | | |
|---|---|---|---|
| 551,910 | 12/1895 | Squier | 165/111 |
| 1,858,972 | 5/1932 | Snyder | 201/29 |
| 2,022,463 | 11/1935 | Evschen et al. | 55/222 |
| 2,127,542 | 8/1938 | Stitzer | 201/29 |
| 2,346,410 | 4/1944 | Ashley | 165/99 |
| 2,762,449 | 9/1956 | Sweeney | 55/222 |
| 2,809,717 | 10/1957 | Schmalenbach | 55/85 |
| 3,707,185 | 12/1972 | Modine et al. | 165/111 |

*Primary Examiner*—Bernard Nozick
*Attorney, Agent, or Firm*—R. Lawrence Sahr

[57] ABSTRACT

A two-stage process, and the apparatus for practicing the process, for cooling process gas are disclosed. The process gas is firstly air-cooled by convection to a temperature above the dew point of naphthalene and finally cooled to the desired discharge temperature by heat exchange with a cooling liquid. The condensed portion of the process gas resulting from the first cooling stage may be utilized to flush the gas conduits of the liquid heat exchanger of the second stage, followed by a recirculation of that condensed portion of the coke oven gas either back through the second stage or by introduction into the stream of process gas prior to its introduction into the first cooling stage.

18 Claims, 2 Drawing Figures

PROCESS AND APPARATUS FOR COOLING COKE OVEN GAS

BACKGROUND OF THE INVENTION

1. Field of the Invention

This invention relates generally to the processing of industrial process gases and specifically to the cooling of raw coke oven gas as the initial step in the processing of the by-product gases therein.

2. Description of the Prior Art

The cooling of raw coke oven gas was traditionally done by air, a method of cooling well known and widely used in the past in the field of art. Initially, the coolers were comprised of a plurality of large diameter upright pipes wherein the raw coke oven gas was conducted through the interior of these pipes and the natural convection of air currents cooled the outside of the pipes, transferring the heat from the raw coke oven gas to the metal pipe and then to the surrounding air where that heat was dissipated. Various improvements were attempted with such coolers including the use of forced draft convection and air flow regulators. However, basic problems which turned out to be commercially insurmountable were found to be inherent in the air-cooling method. Cooling rates were too slow and cooling surface requirements were too great. Also, on particularly hot summer days the direct sun would heat the air coolers to a degree higher than the desired discharge temperature.

Thus the use of air coolers was eventually abandoned in favor of liquid cooling systems. The early liquid cooling systems comprised a primary cooler in the form of a packed column, 50 to 80 feet high. Flushing liquor was pumped to the top of the tower and trickled down over an arrangement of hurdles made of wood slats. The raw coke oven gas was introduced at the bottom of the tower from where it rose upwardly through the hurdles and across the wood slats, making intimate contact with the flushing liquor filtering downwardly. The hot flushing liquor was then pumped from the bottom of the packed column to a cooling and recycling system. Inherent in this system was a loss of static pressure in the gas system. This pressure differential was further increased by the buildup of naphthalene crystals on the slats, insoluble in the water which comprised the aqueous base for the flushing liquor.

The current practice, developed to lower the gas pressure differential, is a water spray system which provides finely divided spray droplets to form a heat transfer surface. Again, a column or tower is used, but not packed. A three-phase spray system is arranged in the tower, including a primary spray section, a secondary or respray section, and a pumping section. Cold water enters the sprays at the top of the tower where there are sufficient spray heads to ensure that the entire volume of the primary spray section is filled with uniformly distributed droplets. After contacting the rising gas, the liquid collects on the top of a gas-distributor plate located at the base of the primary spray section. Most of the water then flows to a respray pump and is recycled to the secondary or respray section where it contacts the hot gas entering the lower section of the tower. The water then collects at the pumping section at the base of the tower where the tar extracted from the raw coke oven gas is allowed to settle and time is allowed for entrained gas bubbles to escape. The hot water is then pumped to a cooling system separate from the tower. The cooling system usually takes the form of an evaporation tower, or a more complex system of heat exchanger towers. Water from the cooling system is then recirculated.

The water spray system described above is classified as a "direct" primary cooler. "Indirect" primary coolers are also well known and currently being used as an alternative to the direct system. Indirect coolers are large box-shaped shell-and-tube heat exchangers in which raw coke oven gas flows through the shell and passes countercurrently to cooling water flowing through tubes. In such a system, the water never actually comes in contact with the gas but, instead, cools the tubes which, in turn, cool the gas flowing around them. The hot water exiting from the indirect cooler is, like the direct cooler system, cooled and recycled.

The water-cooling systems utilized in conjunction with both the direct and indirect primary coolers produce certain operational aspects which are objectionable in the environmental protection sense. Pollution laden steam from the cooling tower discharges directly into the atmosphere as well as promotes the formation of ice on streets and other passageways during winter by condensation of that steam. Noise, at an objectionable decible level, is produced from the combination of convection fans, rushing water, and water flashing into steam. Relatively large quantities of water are required, requiring costly large diameter pipelines, to replace water lost by evaporation and over spray. The water supply in many cases must be filtered and additives introduced to protect against corrosion as well as mineral and scum buildup and accumulation. In some systems there is also an economic necessity to discharge excessively warm water into rivers, creating a thermal pollution problem similar to that experienced with nuclear reactors.

The present invention provides a method and apparatus by which the disadvantages inherent in the previously described primary cooling processes, both air-cooling and water, are largely avoided.

SUMMARY OF THE INVENTION

The present invention provides for a method of cooling preferably raw coke oven gas, after that gas has been conducted through coke oven battery offtake main and the downcomer, at the primary cooler stage. The raw coke oven gas is firstly cooled to a temperature above the dew point of naphthalene, a constituent of that gas, but the utilization of air as the cooling agent. The final cooling to the required discharge temperature is accomplished in a cooler stage which uses water or another appropriate cooling liquid.

The raw coke oven gas enters the primary cooler at a temperature in excess of the melting point of naphthalene; the naphthalene being carried therein partially as a vapor and partially as a gas. The raw coke oven gas is cooled in the first stage of the cooling apparatus to a uniform temperature of just above the dew point, or condensation point, of the napthalene entrained in the raw coke oven gas, preferably a temperature of 65°–70° C. The naphthalene is carried into the primary cooler as a vapor entrained in the raw coke oven gas and condensation occurs as the vapor crystallizes into a solid form.

The raw coke oven gas, still carrying the vaporized naphthalene, slightly above the dew point in temperature, exits the first stage of the cooler and enters immediately into the second stage where it is liquid-cooled and the naphthalene crystallizes but initially remains entrained, but is then quickly dissolved by tar, also in the raw coke oven gas, which has likewise condensed as a result of the temperature drop.

In the first stage of the primary cooler, the cooling is accomplished by indirect action of cooling air current convection across the exterior of heat exchanger conduits through which the coke oven gas is flowing.

The second stage of the primary cooler can be operable either by means of a direct or indirect liquid cooling system. In the direct system, the cooling liquid makes direct contact with the raw coke oven gas, the cooling liquid itself providing the heat transfer surface. In the indirect system, the cooling liquid is separated from the raw coke oven gas, the heat transfer surface being the means of separation. This separation takes one of two basic forms. Either the raw coke oven gas is conducted over the surface of conduit means through which the cooling liquid passes, or the cooling liquid is conducted over the surface of conduit means through which the raw coke oven gas is conducted.

In all of the embodiments of the present invention, of course, ancillary regulatable means are provided to conduct the raw coke oven gas into and out of the primary cooler system, to conduct both the cooling air and the cooling liquid into and out of the primary cooler system, and to provide and ensure effective heat transfer association of both cooling mediums, air and liquid, with the raw coke oven gas.

If an indirect cooling system is used in the second stage of the primary cooler system, some or all of the condensate of the raw coke oven gas produced in the first stage of the primary cooler system can be utilized to flush the gas contact portion of the heat transfer surface, in that second stage, after which the condensate can be recirculated. If a direct cooling system is used in the second stage of the primary cooler system, the condensate of the raw coke oven gas produced in the first stage of the primary cooler system can either be recirculated through the first stage or be delivered to the second stage after intermediate cooling. Further, the condensate of the raw coke oven gas produced in the first stage of the primary cooler system can be utilized to flush the conduits, in that stage, through which the raw coke oven gas passes. The key to the flushing action of the condensate, in all cases, is the inclusion in the system of means to include and maintain tar in the condensate used for flushing.

DETAILED DESCRIPTION

Figure 1:
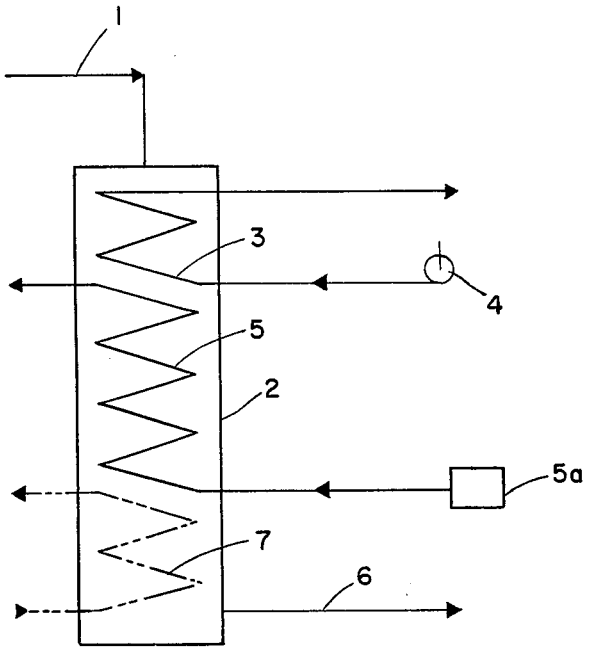
FIG. 1 is a schematic diagram of the basic method of the invention and the apparatus for carrying out that method.

In the basic embodiment shown in FIG. 1, the raw coke oven gas arrives via line 1 at the primary cooler 2, arranged in the form of a transverse tube cooler. The first stage 3 of the cooling system is open and positioned in the topmost section of the primary cooler 2. Air is forced from the bottom of the first stage 3, upwardly in the direction of the arrow indicated thereon, by a blower 4. The first stage 3 is in the form of a conduit, the cooling air being conducted through the interior of that conduit. The raw coke oven gas travels downwardly over the exterior of that conduit, the cooling heat exchange surface being the conduit wall. The cooling heat exchange surface may be provided with fins on the inside and/or outside to extend that surface, thus enhancing calorific transfer.

The second stage 5 of the cooling system is also open and is positioned beneath the first stage 3. A suitable cooling liquid, preferably water from an external cooling tower (not shown), is conducted through the second stage 5, upwardly, in the direction indicated by the arrow shown on the second stage 5. Pump means **5*a* is provided to motivate the liquid through the second stage 5 which is, like the first stage 3, also in the form of a conduit. Additional phases 7 can be added to the second stage 5 to extend the cooling capacity of the second stage 5 by the addition of one or more conduits operable in the same manner as described above for the second stage 5. This permits varying exit temperatures of the raw coke oven gas. The raw coke oven gas is cooled to a temperature just above the dew point of the naphthalene therein, preferably 65°–70° C., at the point where it leaves the first stage 3 and enters the second stage 5 as it travels downwardly through the primary cooler 2. The raw coke oven gas exits the primary cooler at line 6** at the desired temperature for further processing.

The basic embodiment set forth above may also readily be arranged in the form of a vertical tube cooler of the type well known in the art. In such an arrangement, cooling air could be conducted through conduits in both cooling stages, with a cooling fluid being conducted through only the second stage as done in the basic embodiment. The air cooling in the second stage would complement the main cooling effected by the cooling liquid in that second stage, the air serving to directly cool the cooling liquid rather than the raw coke oven gas as such.

Figure 2:
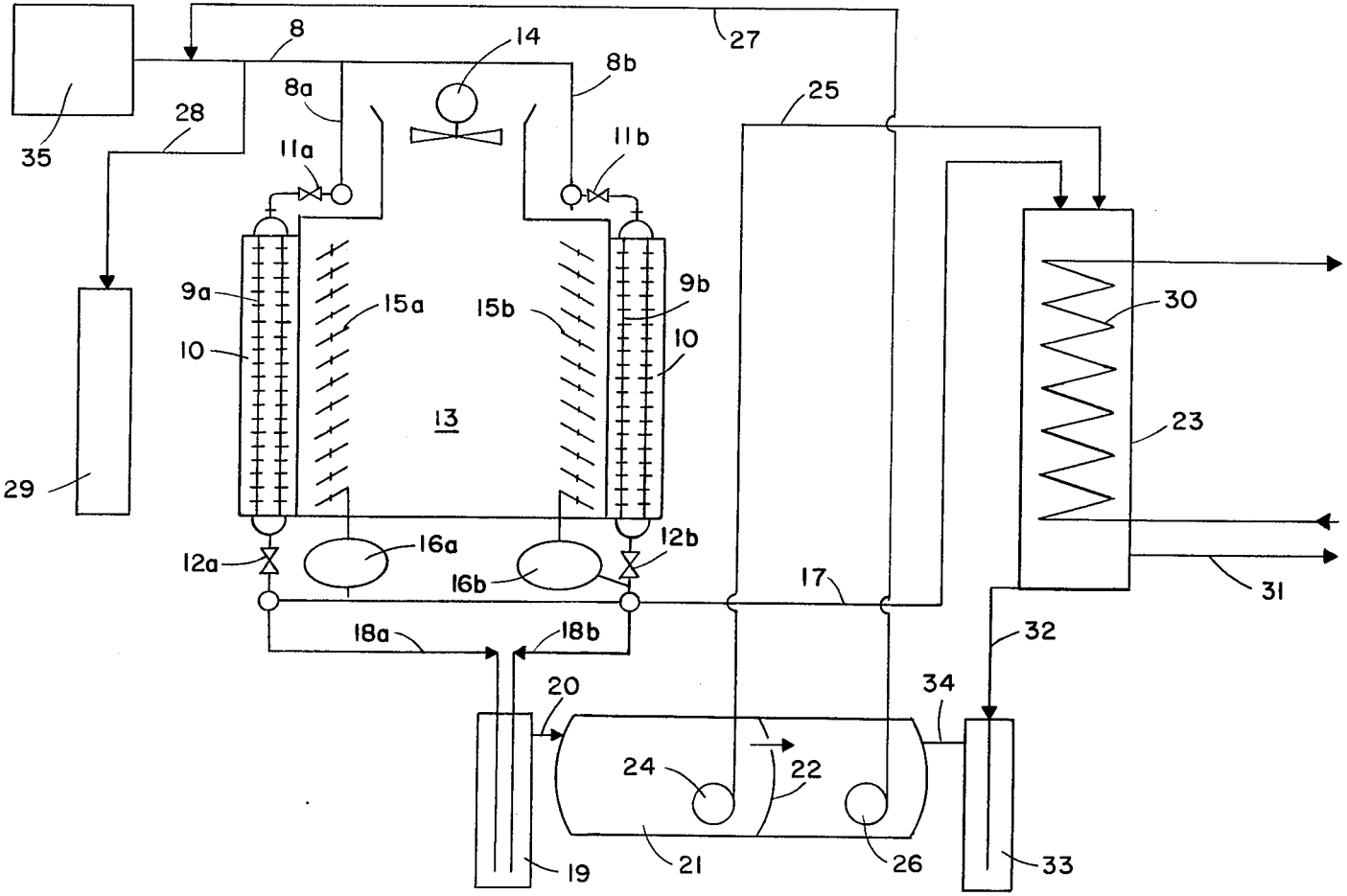
FIG. 2 is a schematic diagram of the preferred embodiment of the method of the invention and the preferred embodiment of the apparatus for carrying out that method.

The preferred embodiment of the invention is depicted in FIG. 2. The first stage of the preferred embodiment is inverse to that of the basic embodiment in that the raw coke oven gas is conducted through conduits while the cooling air flows around the exterior of those conduits. The conduits, or tubes, are oval in cross section, as distinguished from circular, with exterior fins. The tubes are arranged in vertical bundles, with a plurality of these bundles being arranged in parallel with interconnections among the tube bundles to provide parallel flow of fluid as distinguished from a series flow pattern. It is advantageous to arrange the tubes with a steep downward inclination, preferably a vertical positioning. Such an arrangement of the tubes enhances the ability of gas condensates within the tubes to gravity-flow toward the second stage. Apparatus is provided to regulate the temperature of the raw coke oven gas within the first stage. This apparatus takes the form of a controllable throttle discharge system imposed on the rate of cooling air flow through the tube bundles, utilizing, for example, variable speed fan motors or variable louvers or flaps positioned prior to or following the flow of air through the tube bundles, or, alternately, a variable air bypass system could be utilized. Additionally, valving apparatus could be included to disconnect and reconnect individual tube bundles from the plurality of tube bundles.

Referring to FIG. 2, the raw coke oven gas originating at the coke oven battery, generally indicated by the numeral 35, is conducted via line 8 to branch lines **8*a* and 8*b*, where that gas is introduced into preferably upright (vertical) tube bundles 9a and 9b. As represented in FIG. 2, the cooling tubes 10 in tube bundles 9a and 9b are equipped with external fins. In practice, of course, more than two tube bundles can be provided, also arranged in a parallel flow pattern, as the tube bundles 9a and 9b. The total cooling surface area required to cool the raw coke oven gas to the desired temperature is calculated, using well-known design principles. That calculated figure forms the basis for establishing the number of cooling tubes 10 and the number of tube bundles 9a and 9b** required, based on established principles of air cooler design. Further, means are included to remove and replace individual tubes as well as tube bundles for maintenance and repairs without disassembling the whole first stage of the primary cooler as is standard practice in the field of air coolers.

Valves 11a and 11b are mounted in branch lines 8a and 8b so as to enable the regulation and control of the flow of raw coke oven gas from line 8 into the tube bundles 9a and 9b. Each of these valves 11a and 11b is also capable of completely halting flow in the respective branch lines 8a and 8b. On the gas discharge end of the tube bundles 9a and 9b valves 12a and 12b are mounted to provide additional regulation and control means over the flow of raw coke oven gas. Thus the amount of raw coke oven gas, as well as the rate of flow of that gas, are independently subject to regulation and control both into and out of the first stage of the system.

Cooling tube bundles 9a and 9b are accommodated in open housing 13. Preferably, in the top portion of housing 13, a motor driven fan 14 is mounted to induce the required cooling air circulation. Positioned prior to the cooling tube bundles 9a and 9b in the cooling air flow path are variable louvers 15a and 15b, the variation in the cooling air flow path which is automatically controlled by temperature measuring instruments 16a and 16b correlated to monitor the flow of the raw coke oven gas discharge temperature at about the point at which that raw coke oven gas is discharged from the tube bundles 9a and 9b.

After the raw coke oven gas has streamed through cooling tube bundles 9a and/or 9b from the top downward, and is cooled to about 70° C., that gas is conducted to second cooling stage via line 17. The gas condensate from the cooling tube bundles 9a and/or 9b flows through line 18a and/or 18b into sealed vessel 19. The condensate in a liquid and solid form collects in sealed vessel 19 where the solids separate out to the bottom while the liquids flow through line 20 to tank 21, which is divided by an overflow wier 22 into two compartments. Line 20 directs the liquid portion of the gas condensate into the first of these compartments from where it is conducted via line 25 to second cooler stage 23 by pump 24. The gas condensate being conducted via line 25 consists of mostly water and tar, but includes a small percentage of naphthalene. The tar ensures that the naphthalene precipitated in the second cooler stage 23 will be absorbed.

If and when the liquid level in the first compartment of tank 21 reaches the height of the wier overflow 22, the surplus liquid condensate spills over into the second compartment of tank 21. This spill-over of liquid condensate, plus the gas condensate that develops in second-stage cooler 23, is delivered by pump 26 through line 27 to line 8, where it is added to the raw coke oven gas upstream of drain pipe 28 which conveys that combination of condensate, plus any other condensates from coke oven battery 35 that are carried from there into line 8, into flushing liquor vessel 29 to be processed in the usual manner for flushing liquor.

In the preferred embodiment, second-stage cooler 23 is designed as a transverse tube cooler, similar in principal of operation to the transverse tube liquid cooler 5 of the basic embodiment as depicted in FIG. 1. It can be classified as an indirect cooling medium in that the cooling liquid, preferably water, does not make direct contact with the raw coke oven gas. Cooling water flows through the transverse tube bank 30 from the bottom upward, in the direction of the arrow. The raw coke oven gas flows downwardly across and through the transverse tube bank 30 from the top of the second-stage cooler 23, entering through lines 17 and 25, to exit at line 31 at the desired temperature for further processing. Portions of the raw coke oven gas condense, as the temperature decreases, within second-stage cooler 23 and collect at the bottom thereof where they are drawn off via line 32 to sealed vessel 33 which operates in a manner similar to sealed vessel 19. The condensate in a liquid and solid form collect in sealed vessel 33 where the solids separate out to the bottom while the liquids flow through line 34 into the second compartment of tank 21.

As an alternate, a direct cooling medium may be employed in the second-stage cooler. However, if a direct cooler is provided for the second cooling stage, the gas condensate produced in the first cooling stage may either be returned directly and introduced into the stream of raw coke oven gas upstream of the flushing liquor vessel or it may be delivered to the direct cooler of the second stage after intermediate cooling.

Because the raw coke oven gas is cooled only to a point above the dew point of naphthalene in the first stage, the gas condensate produced therein contains little naphthalene. Therefore, this condensate, at a lower temperature, is able to absorb any naphthalene precipitated at subsequent points in the system. Thus, the heat transfer surfaces throughout the system suffer very little coating with naphthalene crystals.

Since the raw coke oven gas entering the second stage of the system has already been pre-cooled to 65°–70° C. in the first stage, the required area of heat transfer surface, and thus the amount of cooling tubing in an indirect system, may be substantially reduced from the found in those indirect liquid primary coolers presently known and used in the field of art. The reduction in the quantity of cooling tubing produces a commensurate reduction in the cooling liquid requirements. And, as a result, the second-stage indirect cooler is considerably smaller in overall dimension. Therefore, the exit dimension of the second-stage indirect cooler is not as proportinately small in relation to the cooler itself, providing more uniform flow of raw coke oven gas through that cooler due to a lesser volumetric decrease from cooler to exit line. Also, the average flow rate of raw coke oven gas through the cooler can be increased as less residence time is required due to less of a difference between entry and exit temperatures.

The effectiveness of the process of the invention utilizing the preferred embodiment of the apparatus is exemplified as follows: Beginning with a flow of 100,000 Normal $m^3$/hour of raw coke oven gas to be cooled down from 82° C. to 25° C., for Example A, the known single-stage water cooling process is utilized, while, for Example B, the two-stage process and apparatus of the preferred embodiment are utilized. For Example B, the first stage, or aircooling stage, is implemented to cool the raw coke oven gas down to 70° C. followed by a second-stage cooling down to 25° C. utilizing water as the cooling medium.

For Example A, the required cooling water throughput is 2,200 $m^3$/hour, while that required for Example B is 1,000 $m^3$/hour. Thus the process and apparatus of the invention per the example requires less than half the water needed for the conventional known water-cooling process.

The advantages offered by the present invention may be summarized as follows:

1. The formation of clouds above the cooling tower and resulting ice formation in winter are reduced.

2. Cooling towers are frequently located at the plant boundaries. Air coolers can be installed in the process field so that residential areas are farther away and noise pollution is reduced.

3. Air coolers, as compared to liquid coolers, involve relatively simple maintenance, and individual portions of an air cooler system may be removed for repair without shutting down the system. Also, spare parts inventory may be reduced in terms of quantity and cost.

4. Regulation of air cooler systems is relatively simple.

5. Make-up water costs (due to evaporation loss) and treating costs for that water, as well as the recirculating water, are lowered (the savings depends on the quality of water; in the example stated above it is 55%).

6. Cooling tower size and cost of operation can be reduced.

7. Air coolers are an improvement over water coolers with respect to noise abatement.

Use of the process according to the invention is, of course, not limited to raw coke oven gas; it may be used for other naphthalene-containing process gases where similar conditions exist.

According to the provisions of the patent statutes, the principle, preferred construction and mode of operation of the present invention have been explained, and what is considered to be its best embodiment has been illustrated. However, it is to be understood that, within the scope of the appended claims, the present invention may be practiced otherwise than as specifically illustrated and described.

What is claimed is:

1. A process for cooling process gas containing naphthalene, comprising:

(a) cooling said process gas to a temperature above the dew point of naphthalene by conducting said process gas through a first heat exchange means wherein air is used as the cooling medium;

(b) conducting said process gas from said first heat exchange means, at said temperature above the dew point of said naphthalene, to a second heat exchange means wherein liquid is used as the cooling medium;

(c) cooling said process gas to a temperature below the dew point of said naphthalene within said second heat exchange means; and (d) conducting said process gas from said second heat exchange medium, (e) condensing a portion of the process gas into a liquid condensate within said first heat exchange means;

(f) separating said condensate from said process gas after said process gas is conducted from said first heat exchange means;

(g) conducting said condensate to said second heat exchange means; and (h) flushing said second heat exchange means with said condensate.

2. The invention described in claim 1 wherein said liquid used as a cooling medium is water.

3. The invention described in claim 1 wherein said process gas is cooled to a range of about 65°-70° C. within said first heat exchange means.

4. The invention described in claim 1 wherein said cooling of said process gas within said second heat exchange means includes:

(a) conducting said process gas into contact with the exterior of conduit means; and (b) simultaneously conducting a liquid cooling medium through the interior of said conduit means.

5. The invention described in claim 1 wherein a portion of said condensate is reintroduced into said process gas prior to conducting said process gas through said first heat exchange means.

6. The invention described in claim 1, wherein a portion of said process gas condenses into a liquid condensate within said first heat exchange means and wherein said cooling of said process gas within said second heat exchange means includes:

(a) conducting said process gas into contact with the exterior of conduit means; and (b) simultaneously conducting a liquid cooling medium through the interior of said conduit means;

further including:

(a) separating said condensate from said process gas after said process gas is conducted from said first heat exchange means;

(b) conducting said condensate to said second heat exchange means; and (c) flushing said exterior of said conduit means with said condensate.

7. The invention described in claim 6 further including intermediately cooling said condensate after said separating but before conducting said condensate to said second heat exchange means.

8. The invention described in claim 1 wherein said process gas is raw coke oven gas.

9. The invention described in claim 8 further comprising:

(a) conducting said raw coke oven gas from at least one coke oven battery to said first heat exchange means; and (b) further processing said raw coke oven gas after said raw coke oven gas is conducted from said second heat exchange means.

10. Apparatus for cooling process gas containing naphthalene comprising:

(a) first stage heat exchange means for cooling said process gas to a temperature above the dew point of naphthalene by conducting said process gas therethrough and wherein air is used as the cooling medium comprising a plurality of vertical tubes through which said process gas flows from top to bottom, means to induce the convection of air into contact with the exterior of the tubes, variable means to control and regulate said convection of air operable in correlation with the temperature of said process gas flowing from the bottom of said tubes and housing means in which said vertical tubes are mounted.

(b) means for conducting said process gas from said first heat exchange stage means, at said temperature above the dew point of said naphthalene, to a second heat exchange stage;

(c) second stage heat exchange means for cooling said process gas therein to a temperature below the dew point of said naphthalene and wherein liquid is used as the cooling medium; and (d) means for conducting said process gas from said second heat exchange stage means.

11. The invention described in claim 10 wherein each of said vertical tubes has a plurality of fins mounted thereto to extend the heat exchange surface of said tubes.

12. The invention described in claim 10 wherein said variable means to control and regulate comprises:

(a) a plurality of variably positionable louvers;

(b) means to vary the position of said louvers;

(c) means to measure the temperature of said process gas flowing from the bottom of said tubes; and (d) means to regulate the position of said louvers in correlation with the temperature of said process gas flowing from the bottom of said tubes.

13. The invention described in claim 10 wherein said variable means to control and regulate includes movable flaps.

14. The invention described in claim 10 wherein said second stage heat exchange means comprises:

(a) a plurality of tubes through which a cooling liquid flows; and (b) means for producing contact of said process gas with the exterior of said tubes.

15. The invention described in claim 14 further comprising:

(a) means for separating liquid condensate from said process gas, said condensate which is formed in said first stage heat exchange means, after said process gas exits said first stage heat exchange means but before said process gas enters said second stage heat exchange means;

(b) means for conducting said separated condensate to said second stage heat exchange means; and (c) means for flushing the exterior of said tubes with said separated condensate.

16. The invention described in claim 10 wherein said second stage heat exchange means comprises:

(a) a plurality of tubes through which a cooling liquid flows; and (b) means for producing contact of said process gas with the exterior of said tubes.

17. The invention described in claim 16 further comprising:

(a) means for separating liquid condensate from said process gas, said condensate which is formed in said first heat exchange means, after said process gas exits said first stage heat exchange means but before said process gas enters said second stage heat exchange means;

(b) means for conducting said separated condensate to said second stage heat exchange means; and (c) means for flushing the exterior of said tubes with said separated condensate.

18. The invention described in claim 17 further comprising:

(a) means for conducting a portion of said separated condensate to said first heat exchange means; and (b) means for flushing said vertical tubes of said first heat exchange means with said separated condensate.

* * * * *